United States Patent [19]

Chulay et al.

[11] 4,290,550

[45] Sep. 22, 1981

[54] MODULAR SUPPORTING CAP AND SPACER FOR CENTRIFUGE TUBES

[75] Inventors: Steven J. Chulay, Los Altos; Francis D. Richards, Sunnyvale, both of Calif.

[73] Assignee: Beckman Instruments, Inc., Fullerton, Calif.

[21] Appl. No.: 122,214

[22] Filed: Feb. 19, 1980

[51] Int. Cl.[3] ..... B04B 15/00

[52] U.S. Cl. ..... 233/26; 422/72; 422/102

[58] Field of Search ..... 233/26; 210/516, 517, 210/518, 782, 789, 927; 422/72, 102; 206/248, 499, 500, 516, 814

[56] References Cited

U.S. PATENT DOCUMENTS

| | | | |
|---|---|---|---|
| 3,720,502 | 3/1973 | Gropper et al. | 422/102 |
| 3,938,735 | 2/1976 | Wright et al. | 233/26 |
| 3,998,383 | 12/1976 | Romanauskas et al. | 233/26 |
| 4,015,775 | 4/1977 | Rohde | 233/26 |
| 4,076,170 | 2/1978 | Chulay et al. | 233/26 |
| 4,080,175 | 3/1978 | Chulay et al. | 422/101 |
| 4,166,573 | 9/1979 | Webster | 233/26 |

FOREIGN PATENT DOCUMENTS

| | | | |
|---|---|---|---|
| 2922208 | 12/1979 | Fed. Rep. of Germany | 233/26 |

*Primary Examiner*—Philip R. Coe

*Attorney, Agent, or Firm*—R. J. Steinmeyer; F. L. Mehlhoff; T. J. Plante

[57] ABSTRACT

A modular spacer concept is disclosed for use in centrifuge bores. The arrangement is such that various sizes of tubes are available to allow for different amounts of fluid which may be inserted therein for centrifugation. A plurality of substantially identical spacers are provided, each of which has an effective length equal to a predetermined standard difference in tube sizes. The lower surface of each spacer has a concave center portion adapted to fit the convex center portion of the upper surface of a tube, and the upper surface of each spacer has a convex center portion adapted to fit the concave center portion of the lower surface of a substantially identical spacer.

10 Claims, 5 Drawing Figures

MODULAR SUPPORTING CAP AND SPACER FOR CENTRIFUGE TUBES

BACKGROUND OF THE INVENTION

This invention relates to the centrifuge field, and particularly to the sample retaining means used in the bores, or cavities, of a centrifuge rotor.

The advantages of the present invention are primarily intended for use in centrifuge rotors having substantially vertical bores; i.e., bores which are parallel to the spin axis. However, the modular spacer which is the subject matter of the present application is also intended to be used in centrifuge rotors having bores which are inclined with respect to the vertical rotational axis.

Furthermore, the present invention appears to have its primary advantages in conjunction with the use of "Quick Seal" sample-containing tubes, which are tubes having their cover areas formed integrally with their bodies, and sealed by fusion of a nipple, or neck, after it has been used for insertion of the fluid sample. Such tubes have proved to be highly advantageous, as compared with earlier open-top tubes, which has to be sealed with separate caps and which, therefore, had serious sealing problems.

The invention of "Quick Seal" tubes is disclosed in Nielsen application Ser. No. 912,698 titled "An Integral One Piece Centrifuge Tube", filed on June 5, 1978 and assigned to the assignee of the present application. Application Ser. No. 912,698 has been abandoned subsequent to the filing on Feb. 15, 1980 of Continuation Application Ser. No. 121,755.

Since "Quick Seal" tubes are thin-walled vessels in which the cover portion is integral with the body portion, the forces developed by centrifuge operation have a tendency to collapse the upper portion of the tube. Such tube-collapsing forces are due both to the hydrauic pressures inside the tube which act vertically on the tube during centrifugation, and to the "buckling" effect on the inner, or centripetal, portion of the tube if significant amounts of air are enclosed in the tube, either entrained in the liquid material or left in the tube because the liquid does not fill it.

In order to prevent deformation of "Quick Seal" tubes, certain precautions must be taken, particularly in providing support for the upper surface of the tube. This may be accomplished by using a supporting cap which engages, and generally conforms to, the top of the tube, even though such a cap is not required for closing, or sealing, the tube. The use of such a supporting cap is disclosed both in Nielsen application Ser. No. 912,698, and in Chulay and Nielsen application Ser. No. 122,324, titled "Supporting Cap for Sealed Centrifuge Tube", filed on Feb. 19, 1980, and also assigned to the assignee of the present application. The latter application is concerned primarily with "floating" caps for use in obliquely oriented rotor bores. In such non-vertical bores, the centrifugal force can be relied on to hold the floating cap in supporting engagement with the top of the tube.

The present application, as indicated above, is primarily concerned with problems relating to tubes in vertical rotor bores. In a vertical bore containing a tube which substantially fills the bore, the large upward forces inside the tube, generated by the hydraulic pressure, are normally opposed by a threaded plug that screws into a counterbore in the top of the rotor body. Such a threaded plug may have direct engagement with the top of the tube, or there may be a small cap inserted between the plug and the tube primarily for the purpose of partially insulating the tube from turning forces created while the plug is being screwed into, or out of, the rotor.

If a smaller amount of fluid is to be centrifuged, it is highly desirable to use a smaller tube, in order to minimize the amount of air remaining in the sealed tube. Use of a shorter tube in a vertical bore requires a spacer to fill the space between the top of the tube and the threaded plug at the top of the bore, since the tube must receive direct support against the vertically acting hydraulic pressures.

In order to make several different sample sizes usable in the same vertical rotor bore, it is desirable to have tubes of different lengths and, therefore, it is necessary to have spacers of different lengths, so that the space between the tube top and the threaded plug may be filled regardless of the size of the tube.

SUMMARY OF THE INVENTION

The present invention provides a modular spacer which acts as a supporting cap for the top of the sample-containing tube, and which is so designed that a plurality of identical spacers can be used if the size of the tube requires. The same spacer may also be used as the floating cap in an obliquely oriented rotor bore.

Each of the identically shaped modular spacers is so designed that its lower surface will engage either the top of the tube or the top of another spacer, and its upper surface will engage either the lower surface of another spacer or the retaining structure secured in the counterbore at the top of the rotor. In other words, the lower surface of each spacer, or cap, has a concave center portion adapted to fit the convex center portion of the upper surface of the tube, and the upper surface of each spacer, or cap, has a convex center portion adapted to fit the concave center portion of the lower surface of a substantially identical cap.

The present invention thus contemplates use of a plurality of sample-containing tubes of different sizes, which are alternately available for use depending on the amount of fluid material to be enclosed in each tube. The available tubes are of different effective lengths, each tube length differing from the others by a predetermined standard distance. A plurality of substantially identical spacers are provided, each of which has an effective length equal to the predetermined standard difference in tube sizes, thereby permitting the use of whatever number of spacers is required to fill the bore.

DETAILED DESCRIPTION OF THE PREFERRED EMBODIMENT

Figure 1:
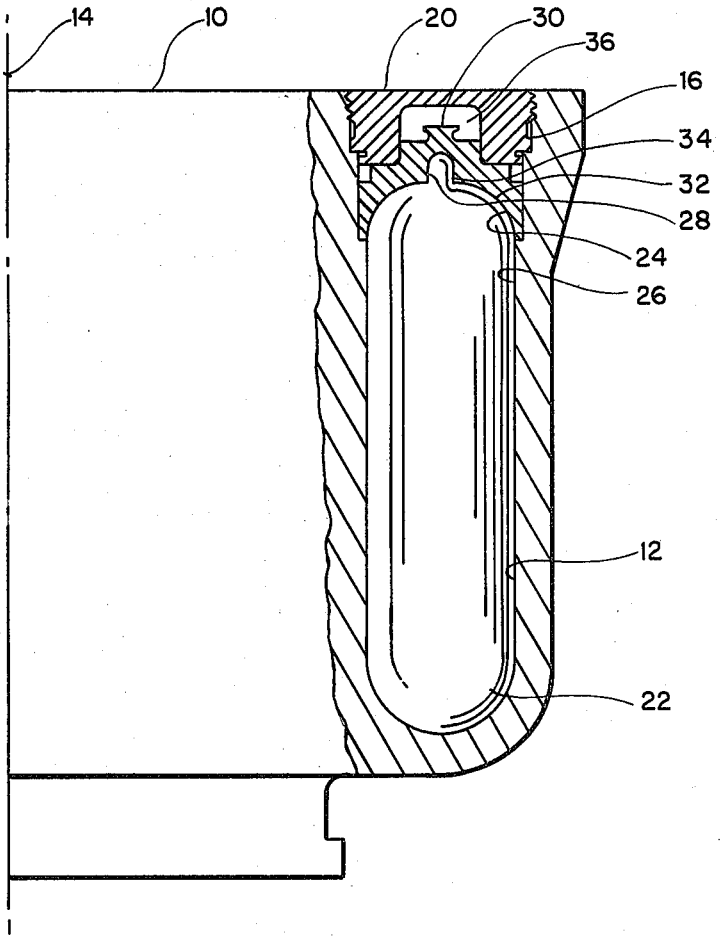
FIG. 1 is a schematic partial sectional view of a centrifuge rotor having a plurality of tube-containing cavities vertically oriented therein.

As shown in FIG. 1, a centrifuge rotor 10 has a plurality of circumferentially spaced bores, or cavities, 12 each adapted to retain a fluid sample during centrifugation. The bores 12 are vertically oriented, and are parallel to the spin axis 14 of the rotor. With this arrangement, the hydraulic pressures developed during centrifugation have an upward component which must be resisted by a closure member secured in the rotor body. For this purpose, a counterbore 16 is provided at the top of bore 12, having internal threads to engage a threaded plug 20 which closes the top of the bore.

In the version shown in FIG. 1, a single sample-containing tube 22 is inserted in the bore 12. This is a "full-length" tube, which conveniently may have a length of three and one-half inches. Obviously other lengths may be chosen, but the specific dimension is stated in order to assist in explaining the inventive concept. The tube 22 is a "Quick Seal" tube of the type disclosed and explained in detail in Nielsen application Ser. No. 912,698. Its cover, or top, portion 24 is formed integrally with its body portion 26 by a suitable process, such as blow-molding. In the center of the top portion 24 of the tube is a projection, or nipple, 28 formed initially as a tube-like extension through which the fluid sample is inserted into the tube, and then hermetically sealed by a suitable process, such as heat fusion. The upper surface 24 of tube 22 is preferably convex in shape, as viewed from above, for reasons discussed at length in Chulay and Nielsen application Ser. No. 122,324. As explained therein, a substantially spherical upper surface of the tube is desirable from a purely functional standpoint, in that it causes minimum interference with the reorienting fluid which is being centrifuged.

In the structure shown in FIG. 1, the upper surface 24 of the tube is formed on a radius substantially longer than the radius of bore 12, with the result that the tube top does not have a truly spherical shape. One advantage of the structure shown in FIG. 1 is that it reduces the overall length of the tube, and thereby reduces the depth of the cavity in the member which engages the top of the tube. In the arrangement shown, a separate cap member 30 is provided between the top of the tube and the threaded plug 20. Cap 30 has a lower concave surface 32 which engages the top 24 of the tube, and at its center has an axially extending hole 34 which accommodates the nipple 28 on the tube. The upper surface of cap 30 engages the lower surface of plug 20, and, as shown, a recess 36 may be provided in the plug to receive a corresponding boss provided on the cap. The plug 20 and cap 30 could be combined into a single element, but their separation into two elements is preferable because it tends to avoid twisting tube 22 in the bore when the threaded plug 20 is screwed into and out of the bore.

Figure 2:
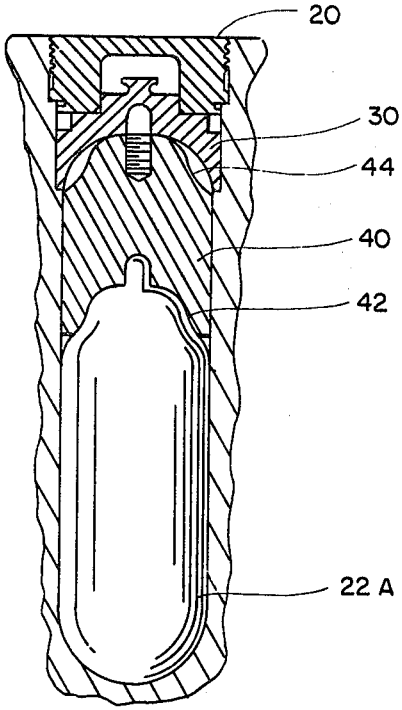
FIG. 2 shows the same rotor cavity as FIG. 1, in which a shorter tube is mounted, in combination with a single modular spacer.
Figure 3:
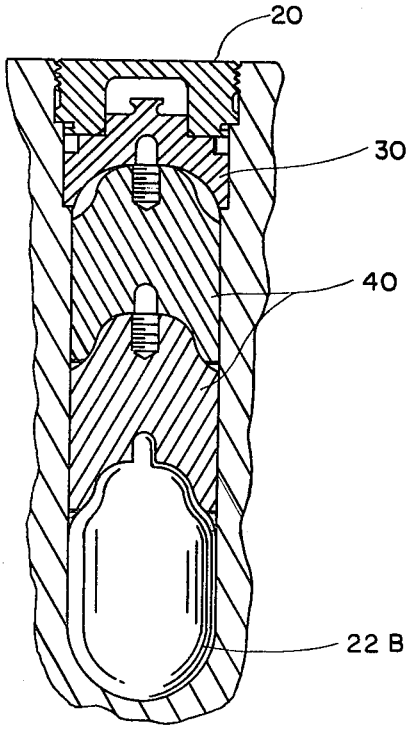
FIG. 3 shows the same rotor cavity as the preceding two figures, in which the shortest standardized tube is mounted, together with two of the substantially identical modular spacers.

FIGS. 2 and 3 disclose the primary concept of the present invention. In each of those figures, a tube is used which is substantially smaller than the tube in FIG. 1. The purpose of using smaller tubes is to match the tube size more closely to the amount of liquid to be centrifuged. If a user prefers to centrifuge a smaller amount of fluid than the full-size tube is designed for, having access to smaller tubes is highly desirable. This is true primarily because it is undesirable to include a significant amount of air in a sealed tube.

In vertical tube-containing bores the hydraulic pressure developed during centrifuging causes a large upward force which is opposed by the threaded plug 20 secured in the top of the bore. Where a shorter tube is used, the space between the top of the tube and the plug 20 must be filled by a suitable spacer which resists the upwardly acting hydraulic pressure. Such a spacer is particularly vital where the tube is one of the "Quick Seal" types, which is a thin-walled vessel subject to bursting, or rupturing, unless it is adequately supported by contact with a cap or spacer engaging its upper surface.

In order to simplify the parts inventory required by a centrifuge user, while at the same time providing a useful range of tube sizes, the present invention provides a modular, or universal, spacer which can be used in combination with any of several standard tube sizes, each of which differs in length from the next tube size by an amount equal to the effective length of the modular spacer.

For example, it has been found convenient to provide tubes of three different lengths for use in the same rotors. A useful size selection comprises tubes of $1\frac{1}{2}''$ length, $2\frac{1}{2}''$ length, and $3\frac{1}{2}''$ length. This permits a modular spacer to be used which has an effective length of 1 inch. Then the $3\frac{1}{2}$ inch tube will be used without a spacer, as shown in FIG. 1. The next shorter tube, which is $2\frac{1}{2}$ inches long, will be used with a single 1 inch spacer in the same bore length having the same threaded plug. And the shortest tube, which is $1\frac{1}{2}$ inches long, will be used with two 1 inch spacers, which engage one another and convey the vertical force to the threaded plug.

Each modular spacer in FIGS. 2–5 is indicated by the numeral 40. Each such spacer is substantially identical with all the others, and it is so shaped that its lower surface 42 has a central concave portion which conforms to the central convex portion of the top of the tube, while its upper surface 44 has a central convex portion which is similar in shape to the central convex portion of the top of the tube, thereby causing the top of the spacer to fit the lower surface of another modular spacer, if one is required.

The tube 22A in FIG. 2 is one inch shorter than the tube 22 in FIG. 1, and a single spacer 40 is located in FIG. 2 between the top of tube 22A and the cap 30, which in turn engages threaded plug 20. The lower surface 42 of spacer 40 engages and substantially conforms to the upper surface of the tube 22A, in order to provide adequate structural support therefor. The specific shape of the modular spacer 40 and of tube 22A will be discussed in more detail below. The center portion of upper surface 44 of spacer 40 preferably conforms to the center of cap 30 (i.e., they are formed along substantially identical radii), but conformity of shape between spacer 40 and cap 30 over a wider area is not required, since the spacer is structurally stiff enough that it does not need a larger area of engagement with cap 30. Spacer 40 will normally be formed of a non-scoring plastic material; threaded plug 20 will generally be metallic; and cap 30 may be either metallic or plastic.

The tube 22B in FIG. 3 is two inches shorter than the tube 22 in FIG. 1, and therefore two spacers 40 are located in FIG. 3 between the top of tube 22B and the cap 30. In order for the spacers to be interchangeable, each has a lower surface which substantially conforms to the top of the tube, and each has an upper surface designed to conform substantially to the lower surface of an identical spacer.

Figure 4:
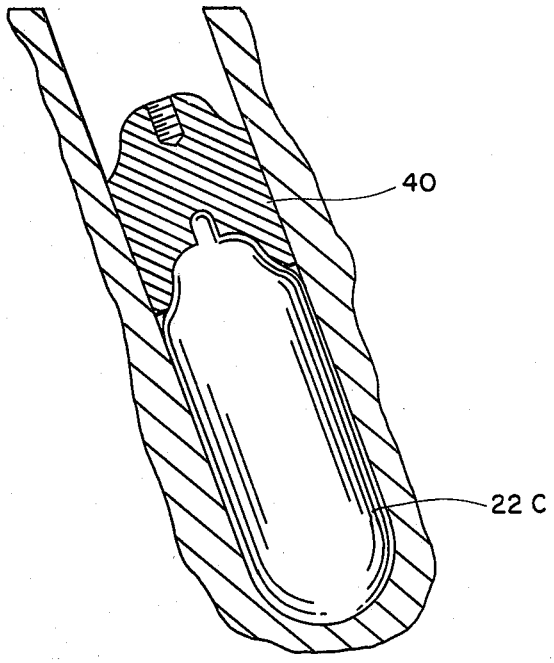
FIG. 4 shows an obliquely oriented rotor cavity in which a modular spacer is used as a floating cap on top of the tube.

FIG. 4 shows the use of modular spacer 40 in conjunction with a Quick Seal tube 22C which is located in an obliquely oriented rotor bore, i.e., a bore which inclines toward the spin axis. In such an inclined bore, the spacer 40 will float, i.e., it will not require a retaining plug, because the centrifugal forces and frictional forces retain the spacer in engagement with the tube. Although the same spacer shape is not required when the spacer floats, it is much simpler to provide support for the tube top in an oblique bore by using the same modular spacer as the one provided for use in vertical bore rotors. Thus, a single spacer structure can be used for tube-top-supporting purposes whenever such support is required.

Figure 5:
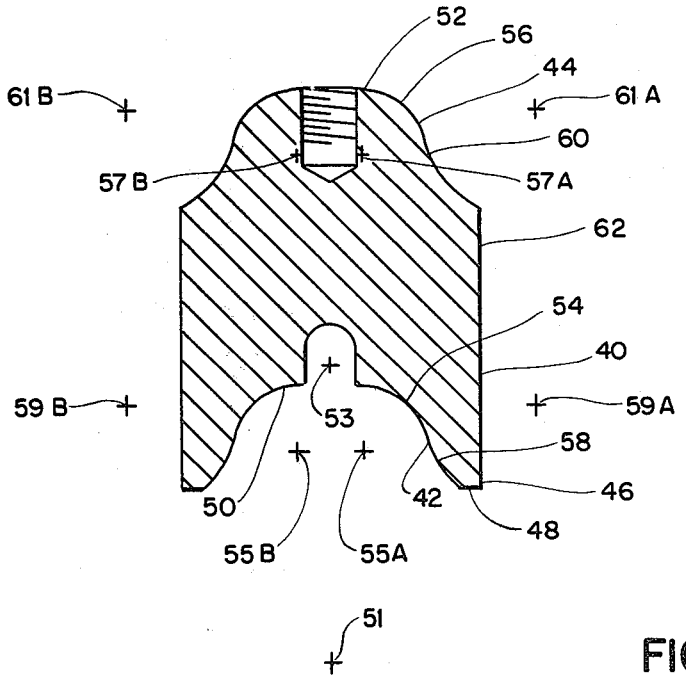
FIG. 5 is a close-up cross-sectional view of the preferred modular spacer configuration.

The preferred structure of the modular supporting cap, or spacer, 40 is shown substantially enlarged in FIG. 5. The design considerations which are important in shaping the tube-engaging lower side of spacer 40 are discussed in detail in Chulay and Nielsen application Ser. No. 122,324. Therein it is explained that the concave portion of the lower surface of the cap or spacer should not extend out to its periphery because of structural weaknesses encountered in such a design. In other words, the spacer should have an annular skirt 46 which is sufficiently thick in cross-section throughout its length to resist deformation during centrifugation. As shown, the annular skirt 46 terminates in a substantially flat annular surface 48, against which the upper peripheral edge of the tube will be pressed during centrifugation.

The particular configuration of the lower surface 42 and upper surface 44 of each spacer 40 can be varied extensively without departing from the primary concepts of the present invention. However, the preferred shape is detailed in FIG. 5. As seen in cross-section, the spherical center portion 50 of lower surface 42 is formed as an arc on a radius centered at 51; and the center portion 52 of upper surface 44 is formed as an arc on an equal radius centered at 53. The annular portion 54 of lower surface 42 adjoining center portion 50 is formed as arcs on much shorter radii centered at 55A and 55B; and the annular portion 56 of upper surface 44 adjoining center portion 52 is formed as arcs on equal radii centered at 57A and 57B. At the outer edge of each of the arcuate surfaces 54 and 56, it is convenient to reverse the shape of the curve by forming an arcuate portion on radii centered on the other side of the formed surface from the centers of the radii described previously. Thus, the annular portion 58 of lower surface 42 near the periphery thereof is formed as arcs on radii centered at 59A and 59B; and these arcs extend to the inner edge of the flat annular surface 48. The annular portion 60 of upper surface 44 near the periphery thereof is formed as arcs on radii centered at 61A and 61B; and these arcs, for reasons of manufacturing economy, preferably extend all the way to the outer cylindrical wall 62 of the spacer. The need for a flat annular surface does not exist at the upper end of the spacer; and the small gap which therefore remains between two mating spacers does not detract from the structural strength of the spacer-to-spacer engagement.

The following claims are intended not only to cover the specific embodiments disclosed, but also to cover the inventive concepts explained herein with the maximum breadth and comprehensive permitted by the prior art.

What is claimed is:

1. For use as a pressure-resisting cap above a sealed tube mounted in an upwardly opening cavity in a centrifuge rotor, the upper surface of said tube having a convexly shaped center portion projecting upwardly in the cavity, a modular cap adapted to engage the top of the tube and having a sliding fit in the cavity;

the lower surface of the cap having a concave center portion adapted to mate with the convex center portion of the upper surface of the tube; and the upper surface of the cap having a convex center portion adapted to mate with a concave center portion of a lower surface of a substantially identical cap.

2. The structure of claim 1 in which the modular cap is mounted in a substantially vertical bore having a counterbore formed at the top thereof, and which structure also includes:

a closure member secured in the counterbore and in operative engagement with the modular cap to prevent the vertical displacement thereof.

3. The structure of claim 1 wherein the tube is mounted in a bore the upper end of which is closer to the spin axis than its lower end, and wherein the modular cap is free, except for the tube, to move toward the bottom of the bore under the effect of centrifugal force.

4. The structure of any of claims 1, 2 or 3 wherein the tube is so formed that its body portion and its upper portion are integrally formed from the same material, which has been fused to seal the tube after insertion of the fluid sample.

5. The structure of claim 4 wherein the tube upper portion has a nipple at its center, and the center of the modular cap has a hole into which the nipple extends.

6. The structure of claim 4 wherein the outer portion of the lower end of the modular cap has a substantially flat annular surface which is only engaged by the outer portion of the upper surface of the tube during centrifugation.

7. The structure of claim 6 wherein the peripheral area of the upper surface of the tube, which encircles its dome-shaped center area, is shaped to generally follow the corresponding portion of the cap, but has first a convexly curved shape adjacent the dome-shaped center portion and then a concavely curved shape adjacent the cylindrical body portion, thereby minimizing changes in the cross-sectional area encountered by reorienting fluid.

8. For use in a substantially vertical bore in a centrifuge rotor, a plurality of alternatively available sample-containing tubes for placement in the bore, said tubes being of different effective lengths, each tube length differing from the others by a distance "X";

a plurality of substantially identical spacers, each having an effective length equal to the distance "X"; and a plug adapted to be secured in the top of the bore to retain the tube and one or more of the spacers therein.

9. The combination of claim 8 wherein:

each tube is an integrally formed thin-walled vessel adapted to be sealed by fusing after insertion of a fluid sample; and the spacer next to the top of the tube provides support for the tube by engagement with most of the area of the upwardly facing tube surface.

10. The combination of claim 8 or claim 9 wherein:

each spacer has an upper surface shaped similarly to the upper surface of the tube, thereby permitting substantially conforming engagement between the upper surface of one spacer and the lower surface of another spacer.

* * * * *